US009596966B1

(12) United States Patent
Taylor

(10) Patent No.: US 9,596,966 B1
(45) Date of Patent: Mar. 21, 2017

(54) TELESCOPIC URINAL HOLDER

(71) Applicant: Jacqueline Taylor, Moncks Corner, SC (US)

(72) Inventor: Jacqueline Taylor, Moncks Corner, SC (US)

( * ) Notice: Subject to any disclaimer, the term of this patent is extended or adjusted under 35 U.S.C. 154(b) by 277 days.

(21) Appl. No.: 14/507,952

(22) Filed: Oct. 7, 2014

(51) Int. Cl.
*A47K 17/00* (2006.01)
*A47K 11/12* (2006.01)
*A61G 9/00* (2006.01)

(52) U.S. Cl.
CPC ..... *A47K 17/00* (2013.01); *A47K 11/12* (2013.01); *A61G 9/006* (2013.01)

(58) Field of Classification Search
CPC ..... A47K 17/00; A47K 11/12; A61H 3/04; A61G 9/006
USPC ..... 4/144.1, 480
See application file for complete search history.

(56) References Cited

U.S. PATENT DOCUMENTS

| | | | | |
|---|---|---|---|---|
| 4,359,789 | A | 11/1982 | Roberts | |
| D297,462 | S | 8/1988 | Meunchen | |
| 5,636,651 | A * | 6/1997 | Einbinder | A61H 3/04 135/65 |
| 5,692,533 | A * | 12/1997 | Meltzer | A61H 3/04 135/65 |
| 5,722,096 | A | 3/1998 | Pfaeffle | |
| 5,772,162 | A * | 6/1998 | Lin | A61M 5/1415 248/121 |
| 5,918,841 | A * | 7/1999 | Sweere | A47B 21/00 248/123.11 |
| 6,116,551 | A | 9/2000 | Pfaeffle | |
| D457,239 | S | 5/2002 | Kunik | |
| 6,857,137 | B2 | 2/2005 | Otto | |
| 7,935,030 | B1 * | 5/2011 | Nesbitt | A61H 3/04 482/142 |
| 2009/0036848 | A1 | 2/2009 | Faiola | |

* cited by examiner

*Primary Examiner* — Tuan N Nguyen

(57) ABSTRACT

The container retention assembly for retaining a urinal at a selected height includes a base that may be positioned on a support surface. The base includes a bottom rod and a top armature that extend upwardly to support a portable urinal. The assembly is adapted to be rolled like a walker or parked adjacent a bed in order for the portable urinal to be supported when not in use.

8 Claims, 4 Drawing Sheets

TELESCOPIC URINAL HOLDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of urine collection systems, more specifically, a telescopic urinal holder for a portable or bedside urinal.

SUMMARY OF THE INVENTION

An embodiment of the disclosure meets the needs presented above by generally comprising a wheeled base that may be positioned on a support surface. The base includes a bottom rod and a top armature that extend upwardly to support a portable urinal. The assembly is adapted to be rolled like a walker or parked adjacent a bed in order for the portable urinal to be supported when not in use.

These together with additional objects, features and advantages of the telescopic urinal holder will be readily apparent to those of ordinary skill in the art upon reading the nonetheless illustrative, embodiments of the telescopic urinal holder when taken in conjunction with the accompanying drawings.

In this respect, before explaining the current embodiments of the telescopic urinal holder in detail, it is to be understood that the telescopic urinal holder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the telescopic urinal holder.

It is therefore important that the claims be regarded as including such equivalent construction insofar as they do not depart from the spirit and scope of the telescopic urinal holder. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
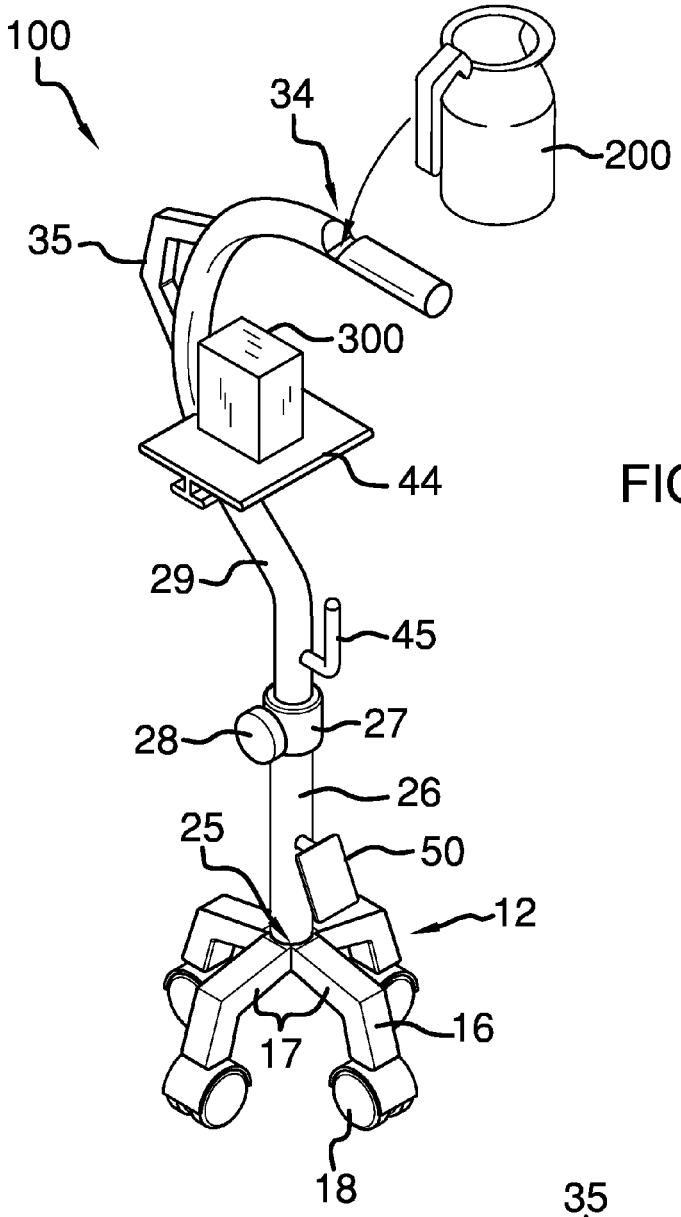
FIG. 1 is a top perspective view of a container retention assembly according to an embodiment of the disclosure.
Figure 2:
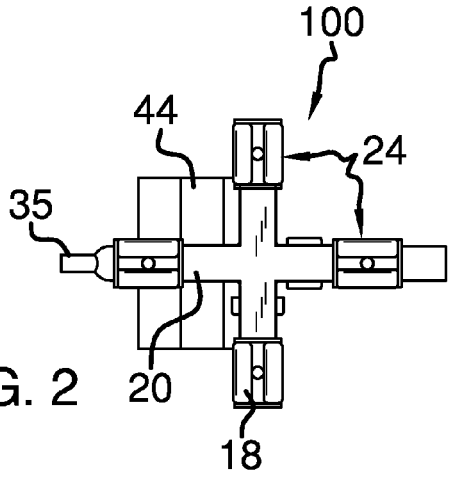
FIG. 2 is a bottom view of an embodiment of the disclosure.
Figure 3:
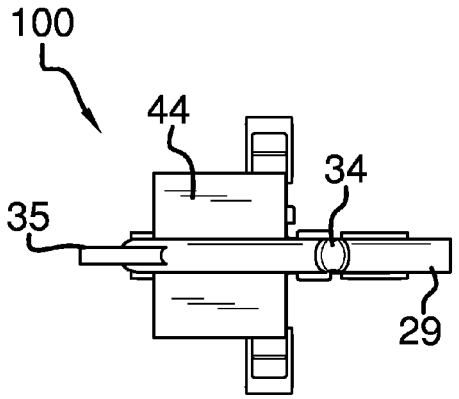
FIG. 3 is a top view of an embodiment of the disclosure.
Figure 4:
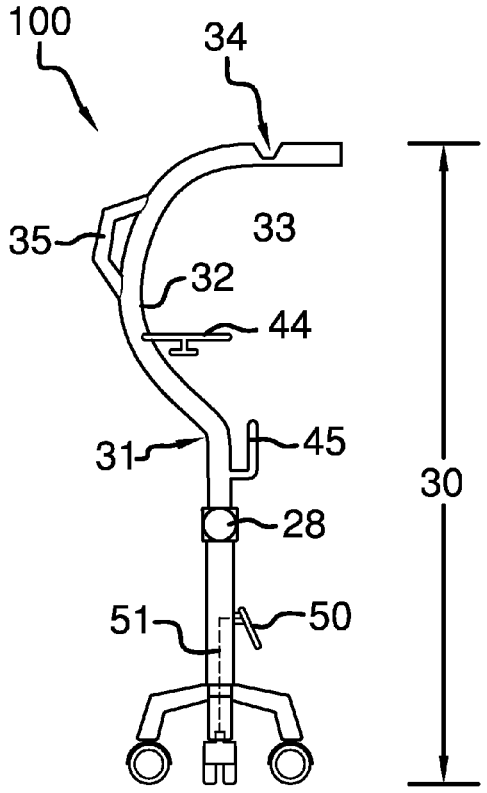
FIG. 4 is a front view of an embodiment of the disclosure.
Figure 5:
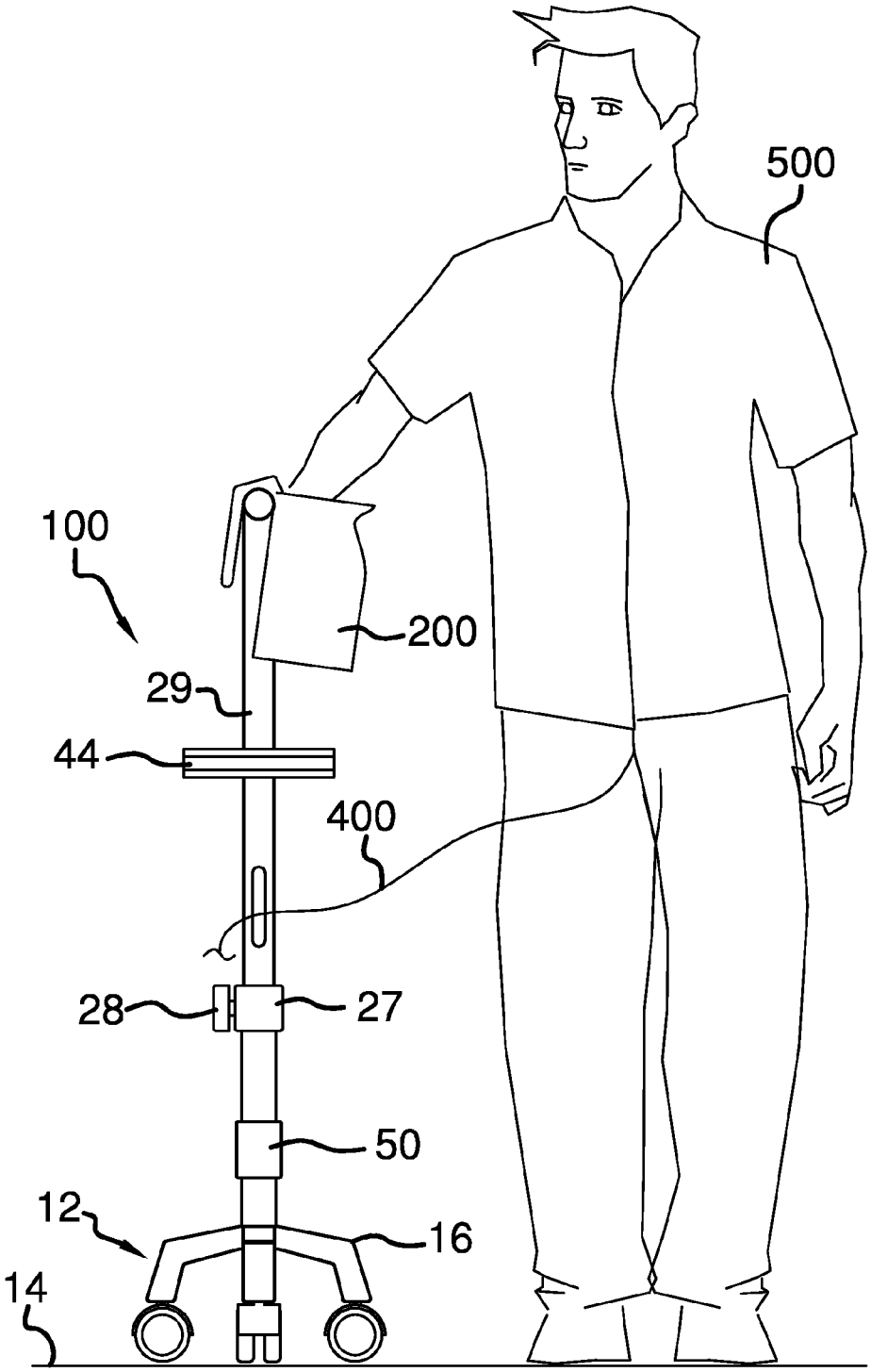
FIG. 5 is an in-use view of an embodiment of the disclosure.
Figure 6:
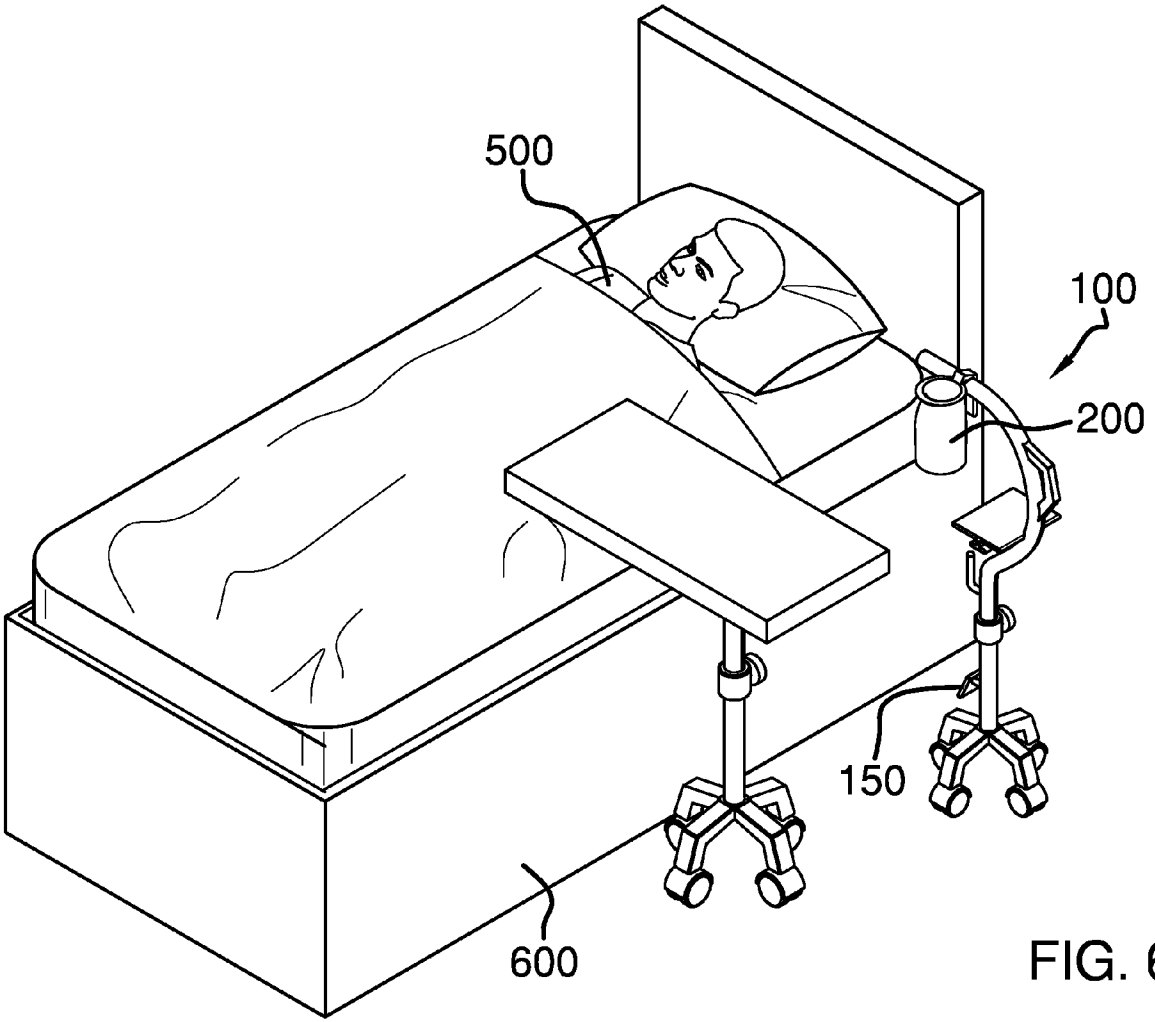
FIG. 6 is another in-use view of an embodiment of the disclosure bedside.

As best illustrated in FIGS. 1 through 6, the telescopic urinal holder 100 (hereinafter invention) generally comprises a base 12 that may be positioned on a support surface 14. The support surface 14 may be a floor. Continuing, an outer edge 16 of the base 12 is angled downwardly. The base 12 has a plurality of armatures 17 that extend downwardly. Each of the plurality of armatures 17 includes a wheel 18 thereon, and which is distally provided.

The wheel 18 is rotatably coupled to a bottom side 20 of the base 12. Additionally, the wheel 18 is positioned proximate the outer edge 16 of the base 12. The wheel 18 abuts the support surface 14 so the base 12 may be rolled along the support surface 14. Moreover, the wheel 18 may be a caster of any conventional design. The wheel 18 is one of a plurality of the wheels 24. Finally, the plurality of wheels 24 is evenly distributed around the base 12.

The plurality of armatures 17 intersect at a union 25. The union 25 is affixed to a bottom rod 26. The bottom rod 26 extends vertically to a coupler 27. The coupler 27 includes a locking member 28 that when rotated secures the bottom rod 26 to a top armature 29. The top armature 29 is slideably engaged with the bottom rod 26. Moreover, the top armature 29 slides into the coupler 27 and a portion of the bottom rod 26. The top armature is slideably engaged with respect to the coupler 27 such that a height 30 may be adjusted.

The top armature 29 has a first bend 31 and a second bend 32. The top armature 29 includes a horizontal portion 33 that defines the height 30. The horizontal portion 33 includes a groove 34 that is adapted to support a portable urinal 200 thereon. The top armature 29 also includes a handle 35 that enables the invention 100 to be used and manipulated as a walker (see FIG. 5).

The top armature 29 includes a first shelf 44 that is affixed thereto. Moreover, the first shelf 44 is horizontally oriented with respect to the support surface 14. The first shelf 44 is also located underneath the horizontal portion 33 of the top armature 29. The first shelf 44 may be used to support a secondary object 300 thereon. Located underneath the first shelf 44 is a catheter hook 45. The catheter hook 45 is adapted to support a portion of a catheter line 400 that may be adjacent a patient 500 when the invention 100 in use.

It shall be noted that the invention 100 may be adapted to be placed adjacent to a bed 600 where the patient 500 is situated. The use of the invention 100 in this situation may require the plurality of wheels 24 to be locked. A foot brake 50 is located on the bottom rod 26, and when depressed shall lock at least one of the plurality of wheels 24 thereby rendering the invention 100 immobile. The foot brake 50 may include a brake lever 51 that extends downwardly into the bottom rod 26, and engages the at least one of the plurality of wheels 24 in order to immobilize the invention 100.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A container retention assembly for retaining a portable urinal at a selected height, said assembly comprising:

a base configured to be positioned on a support surface;

a wheel operationally coupled to said base, said wheel abutting the support surface wherein said base is rolled along the support surface; and a bottom rod coupled to said base, the portable urinal being placed on a top armature that is affixed to the bottom rod;

wherein the portable urinal is retained at a selected position;

wherein a user urinates in the portable urinal;

wherein the base is further defined with an outer edge of the base is angled downwardly;

wherein the base has a plurality of armatures that extend downwardly;

wherein the wheel is one of a plurality of wheels;

wherein each of the plurality of armatures includes one of the plurality of wheels thereon, and which is distally provided;

wherein the wheel is rotatably coupled to a bottom side of the armature of the base;

wherein the plurality of wheels is a caster wheel;

wherein the plurality of wheels is evenly distributed around the base;

wherein the plurality of armatures intersect at a union;

wherein the union is affixed to the bottom rod;

wherein the bottom rod extends vertically to a coupler;

wherein the coupler includes a locking member that when rotated secures the bottom rod to the top armature;

wherein the top armature is slideably engaged with the bottom rod;

wherein the top armature slides into the coupler and a portion of the bottom rod;

wherein the top armature is slideably engaged with respect to the coupler such that a height may be adjusted;

wherein the top armature has a first bend and a second bend;

wherein the top armature is further defined with a horizontal portion that defines the height with respect to the support surface;

wherein the horizontal portion includes a groove that supports the portable urinal thereon;

wherein the top armature includes a handle that enables the assembly to be used and manipulated as a walker;

wherein the top armature includes a first shelf that is affixed thereto.

2. The assembly according to claim 1 wherein the first shelf is horizontally oriented with respect to the support surface; wherein the first shelf is also located underneath the horizontal portion of the top armature; wherein the first shelf is used to support a secondary object thereon.

3. The assembly according to claim 2 wherein located underneath the first shelf is a catheter hook; wherein the catheter hook supports a portion of a catheter line thereon.

4. The assembly according to claim 3 wherein a foot brake is located on the bottom rod, and when depressed shall lock at least one of the plurality of wheels thereby rendering the assembly immobile.

5. The assembly according to claim 4 wherein the foot brake includes a brake lever that extends downwardly into the bottom rod, and engages the at least one of the plurality of wheels in order to immobilize the assembly.

6. A container retention assembly for retaining a portable urinal at a selected height, said assembly comprising:

a base configured to be positioned on a support surface;

a wheel operationally coupled to said base, said wheel abutting the support surface; wherein said base is rolled along the support surface; and a bottom rod coupled to said base, the portable urinal being placed on a top armature that is affixed to the bottom rod;

wherein the portable urinal is retained at a selected position;

wherein a user urinates in the portable urinal;

wherein the base is further defined with an outer edge of the base is angled downwardly;

wherein the base has a plurality of armatures that extend downwardly;

wherein the wheel is one of a plurality of wheels;

wherein each of the plurality of armatures includes one of the plurality of wheels thereon, and which is distally provided;

wherein the wheel is rotatably coupled to a bottom side of the armature of the base;

wherein the plurality of wheels is a caster wheel;

wherein the plurality of wheels is evenly distributed around the base;

wherein the plurality of armatures intersect at a union;

wherein the union is affixed to the bottom rod;

wherein the bottom rod extends vertically to a coupler;

wherein the coupler includes a locking member that when rotated secures the bottom rod to the top armature;

wherein the top armature is slideably engaged with the bottom rod;

wherein the top armature slides into the coupler and a portion of the bottom rod;

wherein the top armature is slideably engaged with respect to the coupler such that a height may be adjusted; wherein the top armature has a first bend and a second bend;

wherein the top armature is further defined with a horizontal portion that defines the height with respect to the support surface;

wherein the horizontal portion includes a groove that supports the portable urinal thereon;

wherein the top armature includes a handle that enables the assembly to be used and manipulated as a walker;

wherein the top armature includes a first shelf that is affixed thereto.

7. The assembly according to claim 6 wherein the first shelf is horizontally oriented with respect to the support surface; wherein the first shelf is also located underneath the horizontal portion of the top armature; wherein the first shelf supports a secondary object thereon; wherein located underneath the first shelf is a catheter hook; wherein the catheter hook supports a portion of a catheter line thereon.

8. The assembly according to claim 7 wherein a foot brake is located on the bottom rod, and when depressed shall lock at least one of the plurality of wheels thereby rendering the assembly immobile; wherein the foot brake includes a brake lever that extends downwardly into the bottom rod, and engages the at least one of the plurality of wheels in order to immobilize the assembly.

* * * * *